US007349639B2

(12) United States Patent
Kojima et al.

(10) Patent No.: US 7,349,639 B2
(45) Date of Patent: Mar. 25, 2008

(54) IMAGE FORMING APPARATUS AND MANAGEMENT SYSTEM

(75) Inventors: Ryuichi Kojima, Toride (JP); Takashi Yahagi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/743,264

(22) Filed: May 2, 2007

(65) Prior Publication Data

US 2007/0286616 A1 Dec. 13, 2007

Related U.S. Application Data

(62) Division of application No. 11/082,919, filed on Mar. 18, 2005, now Pat. No. 7,242,878.

(30) Foreign Application Priority Data

Mar. 23, 2004 (JP) ..... 2004-085409

(51) Int. Cl.
*G03G 15/08* (2006.01)

(52) U.S. Cl. ..... 399/27

(58) Field of Classification Search ..... 399/27, 399/29, 30, 61

See application file for complete search history.

(56) References Cited

U.S. PATENT DOCUMENTS

| | | | | |
|---|---|---|---|---|
| 5,142,325 | A * | 8/1992 | Kai et al. | 399/41 |
| 6,187,490 | B1 * | 2/2001 | Taya et al. | 430/45.56 |
| 6,347,199 | B1 | 2/2002 | Morihara | 399/27 |
| 6,839,534 | B2 | 1/2005 | Matsuda et al. | 399/262 |
| 7,079,795 | B2 | 7/2006 | Hibino | 399/267 |
| 2005/0220463 | A1 | 10/2005 | Yahagi | 399/27 |

FOREIGN PATENT DOCUMENTS

| | | | |
|---|---|---|---|
| JP | 59-100471 | | 6/1984 |
| JP | 9-218584 | A | 8/1997 |
| JP | 10-239980 | A | 9/1998 |
| JP | 10239980 | A * | 9/1998 |
| WO | WO 2005/069084 | A1 | 7/2005 |

* cited by examiner

*Primary Examiner*—David M. Gray
*Assistant Examiner*—Erika J. Villaluna
(74) *Attorney, Agent, or Firm*—Fitzpatrick, Cella, Harper & Scinto

(57) ABSTRACT

An image forming apparatus includes a developing device for developing an electrostatic latent image, formed on an image-bearing member, with toner; a developer supply container which contains developer containing toner and a carrier and is detachably mountable to a main assembly of the image forming apparatus; developer supply means for supplying the developer contained in the developer supply container to the developing device; and developer discharge means for permitting discharge of the developer in the developing device to the outside of the developing device. To the image forming apparatus, one of plural kinds of developer supply containers containing developers having different carrier ratios in the developers is selectively mountable. The image forming apparatus further comprises notification means for providing notification of the kind of the developer supply container to be selected on the basis of information on deterioration of the carrier when the developer supply container is replaced.

6 Claims, 12 Drawing Sheets

IMAGE FORMING APPARATUS AND MANAGEMENT SYSTEM

CROSS-REFERENCE TO RELATED APPLICATION

This application is a divisional of application Ser. No. 11/082,919, filed Mar. 18, 2005 now U.S. Pat. No. 7,242, 878.

FIELD OF THE INVENTION AND RELATED ART

The present invention relates to an image forming apparatus which adopts an electrophotographic process, an electrostatic recording process, etc., and a management system thereof. Particularly, the present invention relates to an image forming apparatus which is provided with a developing means including a two-component developer containing toner and a carrier and provides a good replacement maintenance performance of a developer supply container, and a management system, for managing the image forming apparatus, which systematizes data communication and network management.

In a conventional image forming apparatus, a developing means (developing apparatus) for visualizing an electrostatic latent image on a surface of an image bearing member with a two-component developer containing toner and a carrier, i.e., effecting development has been frequently used.

In such a developing apparatus of the two-component development type, the toner is consumed by a developing operation and on the other hand, the carrier remains in the developing apparatus without being consumed. Accordingly, the carrier stirred together with the toner in the developing apparatus is liable to be deteriorated with an increasing frequency of stirring due to adhesion of the toner onto the surface of the carrier, so that a charging performance of developer is gradually lowered. As a result, an image quality of the resultant image becomes poor. For example, there have arisen such problems that roughening of image in a low density area becomes poor and fog on a white background and deterioration such as a trace of contamination of a charger due to toner scattering are caused to occur.

In view of these problems, e.g., Japanese Laid-Open Patent Application (JP-A) No. SHO 59-100471 (patent document 1) discloses a means for suppressing a lowering in charging performance by supplying a carrier and toner into a developing apparatus. This means has such a constitution that developer which is excessively increased in amount by supply of the carrier and toner overflows a developer discharge opening provided at a wall surface of a developer tank, thus being discharged and recovered by a waste developer container. By successively repeating such supply and discharge operations, the deteriorated developer in the developer tank is replaced with newly supplied (fresh) toner and carrier. As a result, a charging performance is retained to suppress a lowering in copying image quality.

The means disclosed in the patent document 1 discharges the developer in such a manner that a two-component developer comprising toner and a carrier which has been always mixed in constant mixing ratio is supplied to cause the (deteriorated) developer to overflow the developer tank. For this reason, the mixing ratio between the toner and the carrier in the developing apparatus is liable to be changed depending on a stirring mixing state of the developer and a progress (status) of deterioration of carrier in the developing apparatus, so that a further improvement is required.

When such an automatic replacement system that the two-component developer is accommodated in the developing apparatus and the old developer is discharged while supplying the toner and the carrier as described in the patent document 1 is performed, in order to keep a high image quality and permit appropriate supply of carrier, JP-A HEI 09-218584 (patent document 2) discloses such a constitution, as shown in FIG. 12, that a carrier supply portion 102 for containing and supplying a carrier and a toner supply portion 103 for containing and supplying toner are provided in a developing apparatus 101, and the carrier and the toner supplied into a developer mixing and stirring chamber 104 for containing the supplied carrier and toner is, after being mixed and stirred, supplied to a developer container 106 in which deterioration of the developer is detected by a detection means 107 and an amount of carrier to be supplied is controlled by a detection signal from the detection means 107.

By the constitution described above, the carrier and the toner are supplied in an appropriate amount and a sufficiently mixed and stirred state, so that it is possible to suppress a large change in the ratio between the carrier and the toner of the developer in the developer container, thereby to prevent fog, dirt, density irregularity, and the like caused due to insufficient admixture (mixing). Further, by supplying the carrier depending on a status of deterioration of developer, it is possible to prevent excessive carrier discharge in the case where the supply amount of carrier is larger than the amount of toner consumption.

However, in the developing apparatus described in the patent document 2, it is necessary to prepare separately the carrier container for containing the carrier and the toner container for containing the toner, so that spaces for accommodating the respective containers are required.

Further, the mixing and stirring chamber, in which the carrier supplied from the carrier supply portion (carrier container) and the toner supplied from the toner supply portion (toner container) are mixed and stirred, requires a mixing and stirring means for mixing and stirring the carrier and the toner in the mixing and stirring chamber. As a result, the resultant display apparatus has a complicated mechanism, thus being required to ensure a sufficient space therefor.

SUMMARY OF THE INVENTION

An object of the present invention is to provide an image forming apparatus, which performs an automatic carrier replacement system in which a two-component developer containing toner and a carrier is accommodated and old developer is discharged while supplying fresh toner and carrier, capable of retaining high quality image formation by stabilizing a carrier ratio in the developer in the image forming apparatus.

According to an aspect of the present invention is to provide an image forming apparatus, comprising:

a developing device for developing an electrostatic latent image, formed on an image-hearing member, with toner;

a developer supply container which contains developer containing toner and a carrier and is detachably mountable to a main assembly of the image forming apparatus;

developer supply means for supplying the developer contained in the developer supply container to the developing device; and developer discharge means for permitting discharge of the developer in the developing device to the outside of the developing device, wherein to the image forming apparatus, one of plural kinds of developer supply containers containing developers having different carrier ratios in the developers is selectively mountable, and wherein the image forming apparatus further comprises notification means for providing notification of the kind of the developer supply container to be selected on the basis of information on deterioration of the carrier when the developer supply container is replaced.

According to another aspect of the present invention is to provide a management system for managing an image forming apparatus, comprising: a developing device for developing an electrostatic latent image, formed on an image-bearing member, with toner; a developer supply container which contains developer containing toner and a carrier and is detachably mountable to a main assembly of the image forming apparatus; developer supply means for supplying the developer contained in the developer supply container to the developing device; and developer discharge means for permitting discharge of the developer in the developing device to the outside of the developing device, wherein to the image forming apparatus, one of plural kinds of developer supply containers containing developers having different carrier ratios in the developers is selectively mountable, the management system, comprising:

a communication management device for transmitting management data for managing the image forming apparatus, an information management device which is connected with the communication management device in a communicable manner and manages information from the communication management device, and a notification device for providing notification of information from the information management device, wherein the information management device judges the kind of the developer supply container to be selected on the basis of information on deterioration of the carrier when the developer supply container is replaced at and notifies the notification device of information on the developer supply container to be selected.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
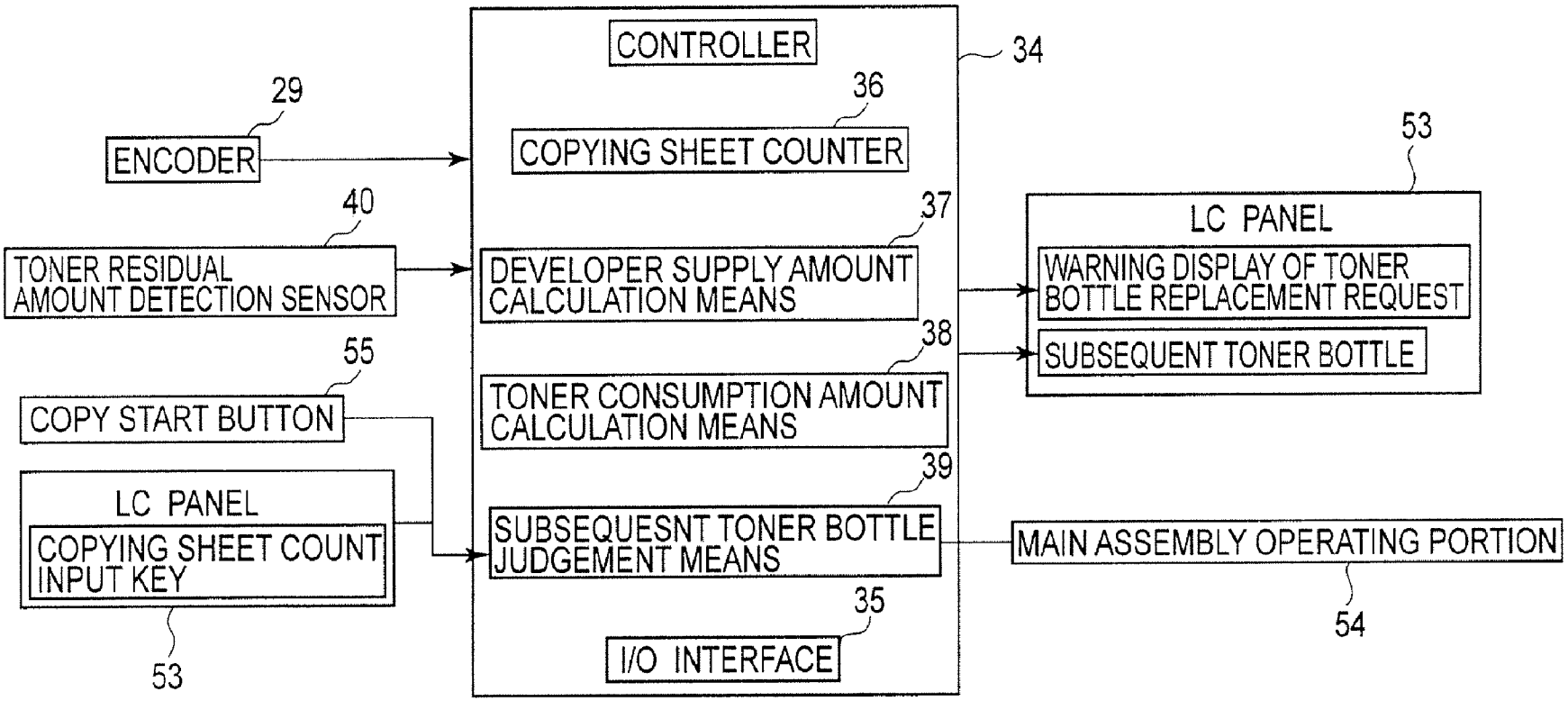
FIGS. 1 and 2 are block diagrams each showing an embodiment of a means for selecting a developer supply container used in the image forming apparatus according to the present invention.

Hereinbelow, the image forming apparatus and the management system for managing the image forming apparatus according to the present invention will be described in detail with reference to the drawings.

Embodiment 1

First of all, with reference to FIG. 11, a general structure of the image forming apparatus of the present invention and an image forming operation performed by the image forming apparatus will be described. As the image forming apparatus in this embodiment, an electrophotographic copying machine 1 is used.

More specifically, the image forming apparatus of this embodiment is an electrophotographic image forming apparatus, i.e., one having a drum-like electrophotographic photosensitive member (photosensitive drum) 2 as an image bearing member. As the image bearing member, it is also possible to use a belt-like electrophotographic photosensitive member.

In the image forming apparatus, an original on which a desired image is recorded is fed to an optical reading system 9 as an image reading portion by an original treating apparatus 11, and image information recorded on the original is read by a CCD 9*a* provided to the optical reading system 9 and then is sent to an image forming portion 8 in which the photosensitive drum 2 is mounted.

In the image forming portion 8, the photosensitive drum 2 is rotated. During the rotation, by an operation performed in an image forming process by an image forming means, a developer image (toner image) is formed on a peripheral surface of the photosensitive drum.

In the image forming process by the image forming means acting on the photosensitive drum 2, the peripheral surface of the photosensitive drum 2 is electrically charged uniformly by a primary charger 7 in a charging step. In an exposure step in a latent image forming step, i.e., an electrophotographic step, on the basis of the image information is read by the CCD 9*a* and sent by the optical reading system 9, the uniformly charged peripheral surface of the photosensitive drum 2 is exposed to light by an exposure portion 10 to change a surface (electric) potential, thus forming a latent image thereon. The thus formed latent image is visualized by attaching developer thereto by use of a developing means (developing apparatus) 3 in a developing step, thus providing a toner image.

The toner image formed on the photosensitive drum 2 is transferred onto a sheet P as a recording material by a transfer means 5. The peripheral surface of the photosensitive drum 2 onto which the toner image has been transferred is cleaned by a cleaning apparatus 6 so as to remove developer and other attachments remaining on the photosensitive drum 2, and then the photosensitive drum 2 prepares for a subsequent image formation.

In this embodiment, the respective developing apparatuses are mounted in a rotary developing unit 3*a* and successively carried to a position opposite to the photosensitive drum 2. In the respective developing apparatus, developers of different colors, such as those containing colorants, of, e.g., yellow, magenta, cyan and black, are contained, respectively.

A first color toner image is formed on the photosensitive drum 2 and is transferred onto the sheet P. A transfer residual developer (toner) for the first color toner image is removed by the cleaning apparatus 6 and then the photosensitive drum 2 is electrically charged again. Then, a second color toner image is formed and then is transferred onto the first color toner image on the sheet P in a superposition manner. As described above, four color toner images are successively transferred onto the sheet in a superposition manner, thus providing a full-color toner image on the sheet P.

Here, the sheet P is fed from a sheet cassette 12 or a manual by-pass tray 23 to an image forming portion 8 and conveyed in an apparatus main assembly through a sheet feeding portion. Then, the sheet P is set to a transfer portion t, for performing thereat a transfer step in the image forming process, as an opposite portion between the transfer means 5 and the photosensitive drum 2 at timing when the toner image formed on the peripheral surface of the photosensitive drum 2 reaches the opposite portion by the rotation of the photosensitive drum 2.

The toner image transferred onto the sheet P at the transfer portion t is fixed on the sheet P in a fixing step to provide a permanent (toner) image.

The sheet P to be discharged as an image formation product after being subjected to the fixing step is conveyed between inner discharge rollers 20 and distributed by a discharge flapper 22. Thereafter, the sheet P is discharged on a sheet discharge portion 15 through outer discharge rollers 21 or, in the case of double-sided printing, is conveyed through a sheet re-feeding conveyance path 16 and a double-sided paths via an inversion path 17 to the image forming portion 8 again, thus being subjected to image formation on another surface.

Incidentally, the manual by-pass tray 23 is used to feed special sheets such as an OHP sheet, thick sheet, etc.

In the above described image forming process, a desired image on the basis of external information on an original is formed on the sheet P.

Also in the above described image forming apparatus 1, the developing apparatus 3 for performing the developing step adopts the two-component developing method of performing a developing operation with (two-component) developer containing toner and a carrier. In the two-component developing method, as described above with reference to the conventional developing apparatus, the toner is consumed and refreshed by supplying fresh toner but the carrier is liable to be deteriorated without being consumed. In the conventional image forming apparatuses using the developing apparatuses described in the patent documents 1 and 2, it was possible to prevent the deterioration of carrier by the automatic replacement method wherein supply means for supplying toner and a carrier are provided and in the developing apparatus, an excessive portion of the resultant developer is discharged by overflow thereof from wall surface of a developer containing tank.

Figure 9:
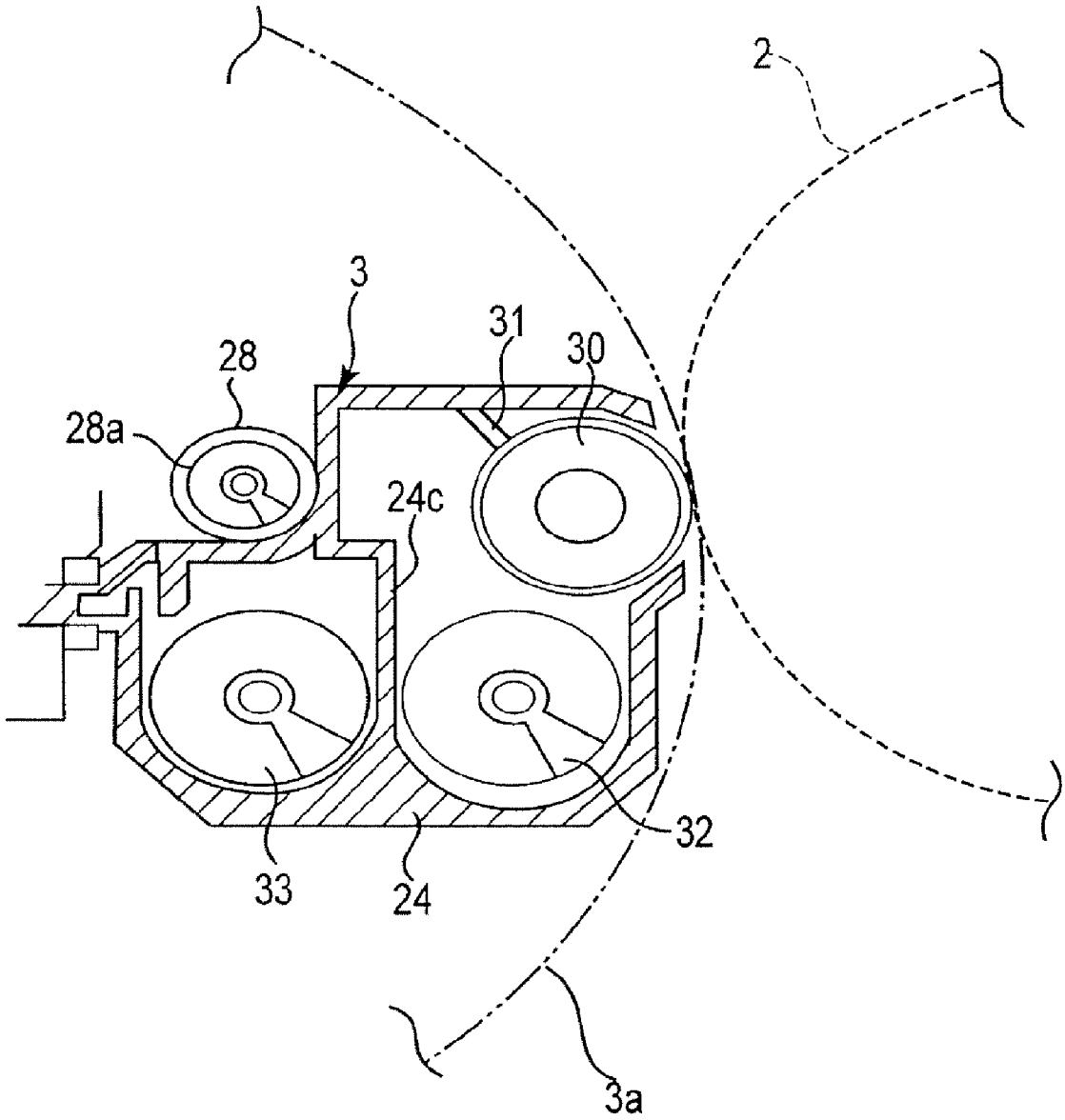
FIG. 9 is a sectional view showing an embodiment of a developing means used in the image forming apparatus of the present invention.

Next, the developing apparatus 3 will be described with reference to FIGS. 9 and 10.

The developing apparatus 3 employs a contact magnetic brush developing method using two-component developer containing toner and a carrier. Also in the developing apparatus, in order to perform the above described automatic replacement of developer, i.e., a trickle scheme, supply and discharge of developer are effected.

The developing apparatus 3 includes a developer container (developing container) 24 for effecting development while circulating the two-component developer, a developer supply means for performing a supply of developer from a toner bottle as a developer supply container in which fresh toner and a fresh carrier are accommodated, and a developer discharge means for revering deteriorated developer in a developer recovery tank 27.

The developer container 24 is provided with a developer supply opening 24*a* and a developer discharge opening 24*b*. From the developer supply opening 24*a*, a developer feeding path 28 for feeding and supplying the toner and the carrier contained in the toner bottle 25 is extended. In the developer feeding path 28, a feeding screw 28*a* as a feeding member is disposed. The feeding screw 28*a* is rotated by an unshown developing device drive motor through a clutch. At an upstream end of the feeding screw 28*a* in a developer feeding direction, an encoder 29 for detecting an amount (number) of rotation of the feeding screw 28*a* is integrally attached to the feeding screw 28*a*.

To the developer discharge opening 24*b*, a discharge pipe 26 as a developer discharge means for permitting discharge of deterioration developer is connected. In the discharge pipe 26, a screw 26*a* is disposed to permit discharge of the deteriorated developer. At a lower end of the discharge pipe 26, the developer recovery tank 27 is disposed detachably mountable to the discharge pipe 26.

In the developer container 24, a developing roller 30, as a developer carrying member for feeding the developer contained in the developer container 24 to the surface of the photosensitive drum 2, disposed opposite to the photosensitive drum 2; a layer thickness regulation member 31, formed of a nonmagnetic material, which is disposed apart from the developing roller 30 at a predetermined distance and regulates a layer thickness of the developer carried on the developing roller 30; a screw 32 for stirring the developer and feeding the developer onto the developing roller; and a screw 33 for feeding the developer are disposed.

The inside of the developer container 24 is partitioned by a partition wall 24*c* into an upstream accommodated portion and a downstream accommodating portion. The screws 32 and 33 are disposed in the upstream and downstream accommodating portions, respectively. The partition wall 24*c* does not reach the inner surface of the developer container 24 at both ends thereof. At the both ends of the partition wall 24*c*, the upstream and downstream accommodating portions communicate with each other in the developer feeding direction.

When fresh developer is supplied from the toner bottle 25 to increase a volume of the developer in the developer container 24, the developer in the developer container 24 overflows the developer discharge opening 24*b* to effect trickle.

Incidentally, in the developing apparatus 3, a developer concentration detection mean (toner concentration sensor) 51 for detecting a toner concentration (a T/D (toner/developer) ratio), which is a ratio of toner to developer in the developing container, by measuring a permeability of the developer is provided. Based on a value detected by the sensor 51, toner consumption in the developer is detected and an appropriate amount of developer is supplied to the developing apparatus 3 by adjusting an amount (number) of rotation of the supply screw 28*a*.

As described above, when fresh developer is supplied from the toner bottle 25 to increase a volume of the developer in the developer container 24, the developer contained in the developer container overflows the developer discharge opening 24*b*, so that automatic container refreshing (ACR) is performed In the developing container 24, the developer supply opening 24*a* and the developer discharge opening 24*b* are disposed apart from each other so that the developer discharge opening 24*b* and the developer supply opening 24*a* are disposed in this order from the upstream side to the downstream side in the developer conveyance pass formed by the screws 32 and 33.

The toner bottle 25 is detachably mountable to the main assembly of the image forming apparatus and is constituted as a replaceable member. When the developer in the toner bottle 25 is consumed, the toner bottle 25 can be replaced with another new toner bottle 25.

Therefore, a toner residual amount detection sensor 40 for detecting a residual amount of the developer in the toner bottle 25 is disposed. This toner residual amount detection sensor 40 transmits a signal for indicating there is a less amount of developer in the toner bottle 25 to a controller 34, described later, which externally displayed instructions to replace the toner bottle 25.

In the above described toner supply method which adopts the trickle scheme, characteristic features of the present invention are that a plurality of toner bottles 25 containing developers having different mixing ratios between toner and carrier are mountable in order to retain a high image quality and that an operator (user) can selectively use an appropriate toner bottle 25 from the plurality of the toner bottles 25.

On the other hand, in the conventional image forming apparatus described in the patent document 2, it is necessary to prepare separately a carrier and a toner container for containing toner in order to retain a high image quality. Further, a mixing and stirring chamber and a mixing and stirring means for mixing and stirring the toner with the carrier are required in the conventional image forming apparatus. However, in the present invention, such a complicated constitution becomes unnecessary, so that it is possible to realize a simple constitution.

As described in this embodiment, in the image forming apparatus 1 to which the plurality of toner bottles 25 of different types are mountable, a selection means for judging that which toner bottle 25 should be mounted and select the toner bottle 25 and a notification means for externally providing notification of the selection of the toner bottle 25 are required. A means, provided with the selection means and the notification means, for controlling the above described developer replacement through the trickle scheme is the controller 34, disposed in the image forming apparatus 1, for effecting control of the image forming means as shown in a block diagram of FIG. 1.

The controller 34 includes an I/O (input/output) interface 35, a copying sheet counter 36, a developer supply amount calculation means 37, a toner consumption amount calculation means 38, a subsequent toner bottle judgement means 39, etc.

To the I/O interface 35, a copy start button 55 and a liquid crystal (LC) panel 53 are connected and a set number of copying sheets can be inputted by the liquid crystal panel 53. Further, the liquid crystal panel 53 displays a bottle number of an appropriate toner bottle 25 to be replaced, thus becoming a display means for displaying externally information.

Into the controller 34 as constituted above, an inputted copy start signal, a set number of copying sheets, an encoder detection signal (a toner supply amount detection signal), a toner residual amount, and the like are inputted.

In this embodiment, either one of toner bottles 25 of two types having a carrier ratio of 10% and a carrier ratio of 30% is mountable to the apparatus main assembly, and the controller 34 is used as the selection means for selecting a toner bottle to be used in a subsequent image formation depending on information as to deterioration of a carrier contained in the developer in the toner bottle. In this embodiment, a toner consumption amount per one sheet for image formation is obtained on the basis of information on the number of image formation, i.e., the number of copying sheets counted by the copying sheet counter 36 and information by the toner residual amount detection sensor 40 provided with respect to the toner bottle 25, and judgement is made as to which toner bottle should be used in a subsequent image formation. Further, the controller 34 communicates with the toner residual amount detection sensor 40 provided in the toner bottle 25 and on the basis thereof, the controller 34 also functions as the notification means for displaying a signal for indicating a request of replacement of the toner bottle 25.

Here, control of the toner supply operation and the controller 34 in this embodiment will be described.

When an image forming apparatus is shipped, a value of the copying sheet counter 36 incorporated in the controller 34 is set to 0. When a user performs copying by the image forming apparatus, the value of the counter 36 is integrated. When the user continues the copying operation, toner contained in the toner bottle 25 is gradually consumed. A residual amount of the toner in the toner bottle 25 is detected by the toner residual amount detection sensor 40 and when the toner residual amount is not more than a predetermined amount, warning display for requiring toner bottle replacement is effected on the liquid crystal panel 53. A toner consumption amount per (one) sheet (mg/sheet) is calculated by the toner consumption amount calculation means 38 according to the following equation (1):

Toner consumption amount (mg/sheet)=(toner consumption amount)/(integrated value of copying sheets)=[(initial developer filling amount in toner bottle 25)−(detected toner residual amount)]/(integral value of copying sheet counter 36) (1).

From this calculation result, a toner bottle 25 of a toner/carrier ratio which should be replaced for a subsequent image formation operation is judged in accordance with Table 1 shown below, and a bottle number of the toner bottle 25 is displayed on the liquid crystal panel 53. In Table 1, with respect to the toner consumption amount per sheet, a toner bottle 25 of an optimum carrier ratio is shown. Incidentally, data in Table 1 are provided in an operating portion 54, of an electrophotographic copying machine (image forming apparatus), communicating with the subsequent toner bottle judgement means 39 and can be inputted by the user with respect to a toner bottle 25 of a desired carrier ratio.

TABLE 1

| Toner consumption (mg/sheet) | Toner bottle number | Carrier ratio in toner bottle |
|---|---|---|
| <68.6 | 1 | 10% |
| ≧68.6 | 2 | 30% |

The user or a service person as the operator prepares a corresponding toner bottle 25 in accordance with the display on the liquid crystal panel as the external notification and display means and replaces the (old) toner bottle 25 with the corresponding (new) toner bottle 25. When the toner bottle 25 is replaced, the value of the copying sheet counter 36 is returned to 0.

Further, in this embodiment, when the toner consumption amount per sheet is large, i.e., when the integral value of the copying sheet counter 36 is small, it is possible to make a judgement that deterioration of the carrier is large and select the toner bottle of the higher carrier ratio. In other words, it also becomes possible to simply choose the toner bottle 25 on the basis of the numerical value of the copying sheet counter 36.

Incidentally, in the present invention, the selection means for judging as to which toner bottle should be selected as the toner bottle 25 to be replaced is not restricted to the above described means.

For example, it is also possible to judge the toner bottle 25 to be replaced on the basis of a calculation result by providing an integral video counter (For counting an integral value of pixels constituting an image) to the controller 34 and calculating an average video value per sheet (an average pixel number per sheet) from the integral value of the integral video counter and the integral value of the copying sheet counter 36. The average video value is calculated according to the following equation (2):

$$\text{Average video value per sheet}=(\text{integral value of integral video counter})/(\text{integral value of copying sheet counter 36}) \quad (2).$$

Further, the above calculated average video value per sheet is an average image video value means that the toner bottle 25 to be replaced is judged on the basis of the average image proportion. The relationship between the average image proportion and the video value is represented by the following equation (3):

$$\text{Average image proportion}=\text{average video value per sheet}=(\text{integral value of integral video counter})/(\text{integral value of copying sheet counter 36}) \quad (3).$$

In this case, particularly, in the case where the calculated average image proportion is not less than 20% and not more than 100%, a toner bottle 25 of a carrier ratio in developer of not less than 20% and not more than 50% is used. Further, in the case where the calculated average image proportion is less than 20%, a toner bottle 25 of a carrier ratio in developer of not less than 1% and less than 20% is used. As a result, the carrier is appropriately supplied, so that it is possible to retain a higher image quality.

As described above, when there is a certain means for detecting information on toner deterioration, it is possible to judge the toner bottle 25 to be replaced for subsequent image forming operation by utilizing the detection means.

Further, in this embodiment, Table 1 is used as the table for judging the toner bottle 25, to be replaced, by the subsequent toner bottle judgement means, but ins merely an example. Accordingly, the values in the table are not limited to those shown in Table 1. In the present invention, such values vary depending on a product used, so that optimum values are set in the table with respect to a corresponding product.

Further, in Table 1, the toner bottles 25 of two types are used but the number of types of toner bottles 25 is also not limited thereto. With an increasing number of types of toner bottles 25, it is possible to more minutely comply with a deterioration status of the carrier and thus retain a higher image quality.

In this embodiment, the liquid crystal panel 53 is used as the notification means for externally providing notification of the bottle number of the toner bottle 25 judged by the subsequent toner bottle judgement means 39 and the display means for displaying the bottle number. However, the notification means of the bottle number of toner bottle 25 is not restricted thereto in the present invention. Any means may be used so long as it can notify the bottle number of toner bottle 25 of the user or the service person. For example, notification of the toner bottle number may be provided by audio assist or utilization of an LED.

According to this embodiment, the following effects can be achieved.

In the conventional image forming apparatus, the carrier supply portion and the toner supply portion are separately provided, and it is necessary to use the mixing and stirring means for mixing and stirring the carrier with the toner in the mixing and stirring chamber in which they are mixed and stirred by supplying the carrier from the carrier supply portion and supplying the toner from the toner supply portion. However, in the present invention, the carrier deterioration status is judged from the number of image formation, the average image proportion, etc., and on the basis thereof, the toner bottle 25 is replaced with a toner bottle having a different toner/carrier mixing ratio. As a result, an amount of carrier supplied depending on the carrier deterioration status becomes appropriate, so that a suitable supply operation can be performed. In addition, a complicated constitution as in the conventional image forming apparatus can be eliminated.

Accordingly, by the present invention, a high image quality similar to that in the case of the conventional image forming apparatus can be retained by the simple constitution and it becomes possible to appropriately supply the carrier similarly as in the conventional image forming apparatus. Further, it is possible to reduce a size of the image forming apparatus.

Incidentally, in this embodiment, constitutions of the image forming apparatus, the developing means, the developer supply container, and the automatic replacement mechanism of carrier in the developing device may be other ones.

Figure 11:
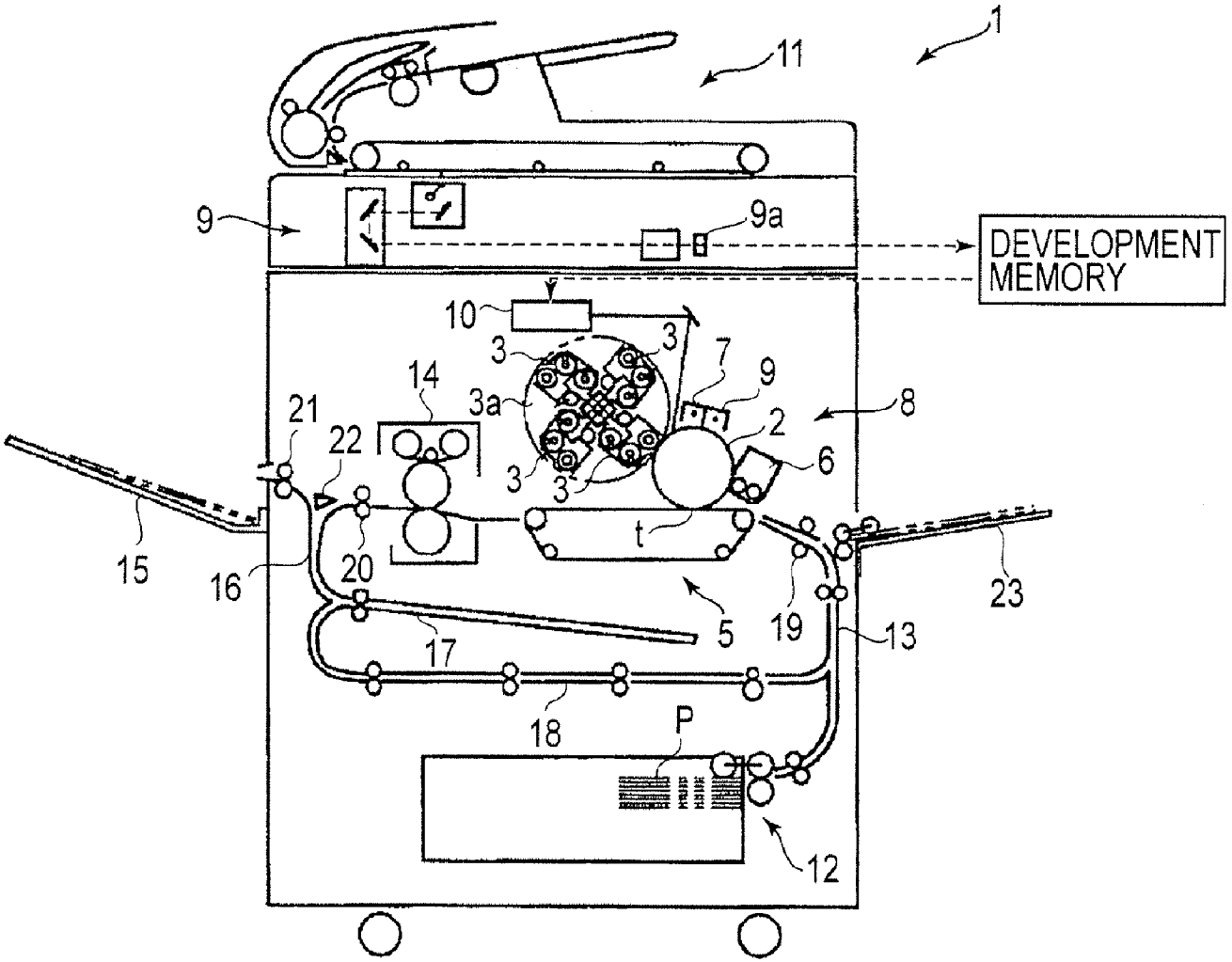
FIG. 11 is a schematic structural view showing an embodiment of the image forming apparatus of the present invention.
Figure 12:
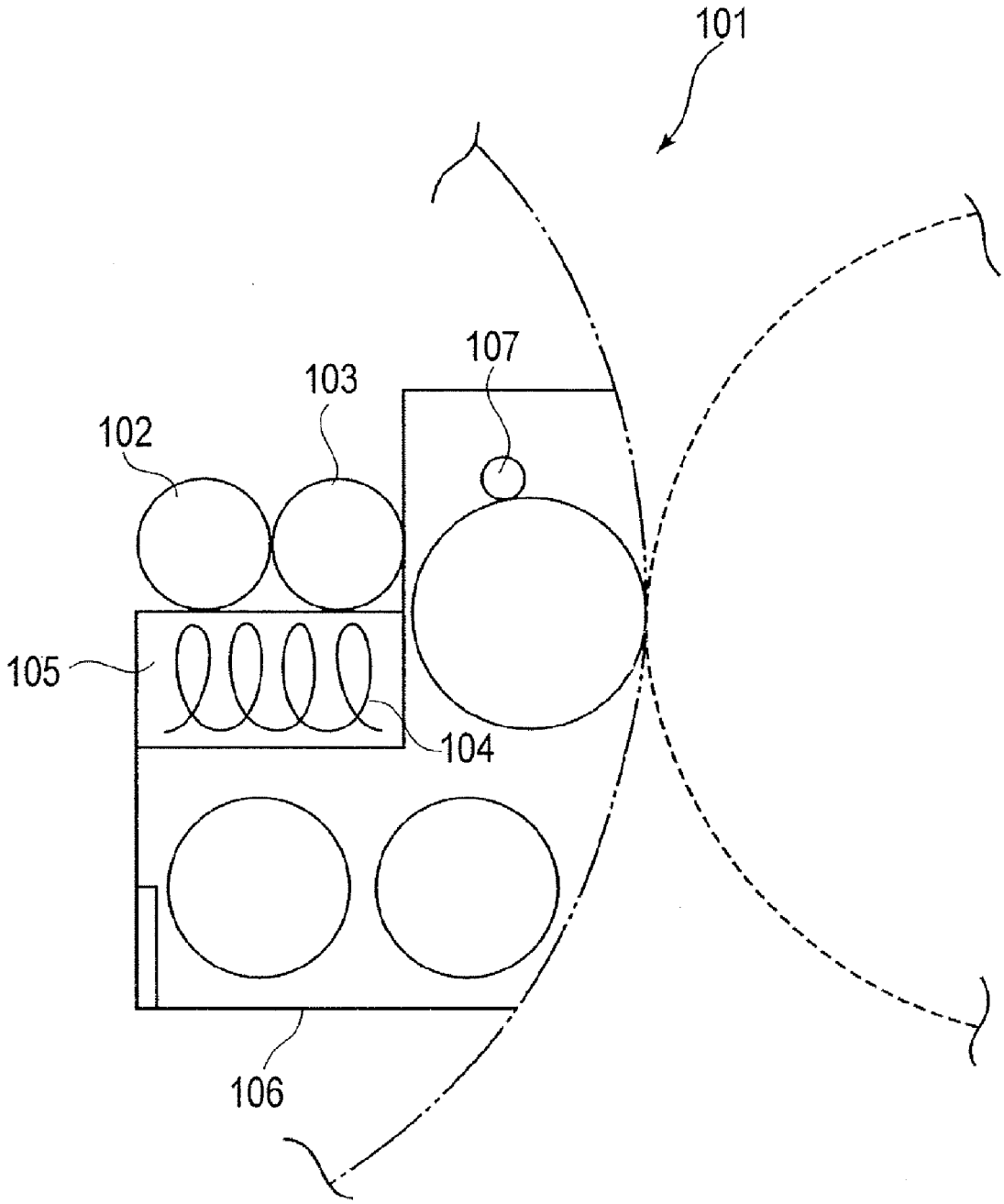
FIG. 12 is a sectional view showing an embodiment of a conventional developing means.

In this embodiment, as the image forming apparatus, the electrophotographic copying machine 1 described with reference to FIG. 11 is used. However, the image forming apparatus may be an electrostatic recording-type image forming apparatus and is applicable to a printer or a copying machine which are connected to a computer. In the case where the image forming apparatus is connected to the computer, when the computer is a network-ready computer, as the notification means, it is also possible to externally provide notification through a signal, for toner bottle replacement, which is transmitted from a printer to the computer. Further, as described later in Embodiment 5, the image forming apparatus may also be modified so that it is connected to an external computer and information is transmitted to the computer to immediately notify a service person of the information.

Further, dimensions, materials, shapes, and relative positions of constitutional parts of the image forming apparatus are not particularly limited to those described herein unless otherwise specified.

Embodiment 2

Figure 2:
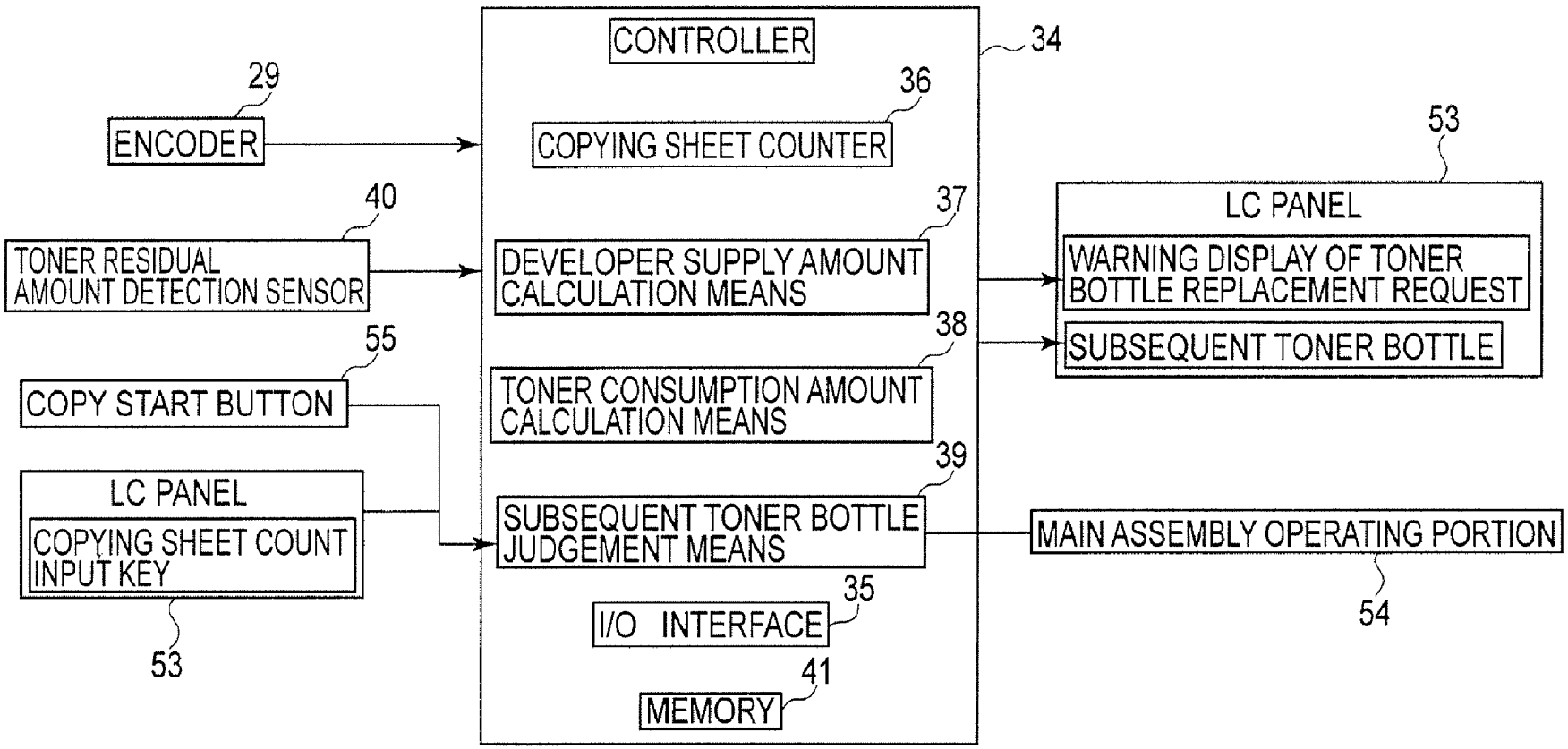

In this embodiment, the constitution of the controller 34 as the selection means for the toner bottle 25 in Embodiment 1 is changed to that of a controller 34 shown in FIG. 2.

In this embodiment, an integrated value of a copying sheet counter 36 is not canceled even when a toner bottle 25 is replaced and the number of copying sheet is further integrated as it is. In other words, the resultant integrated value means the number of copying sheets counted from the time of shipping.

In the controller 34, a memory (storage means) 41 is disposed, and a toner consumption amount calculated at the time of replacing the toner bottle 25 is integrated in the memory 41 every replacement of toner bottle 25. As a result, a total amount of toner consumption from the time of shipping to the time of previous replacement of toner bottle 25 is stored in the memory 41.

Other constitutions of this embodiment are identical to those in Embodiment 1, so that members (means) identical to those in Embodiment 1 are indicated by identical reference numerals and explanation thereof will be omitted.

Next, an operation of the image forming apparatus in this embodiment will be described.

When the image forming apparatus is shipped, both of a value of a copying sheet counter 36 and a total amount of toner consumption stored in the memory 41 are 0.

When a user effects copying with the image forming apparatus 1, the resultant number of copying sheets is integrated in the copying sheet counter 36. When the user further continues copying, toner in the toner bottle 25 is gradually consumed. A residual toner amount in the toner bottle 25 is detected by a residual toner amount detection sensor 40. When the residual toner amount is not more than a predetermined amount, warning about a request of toner bottle replacement is displayed on a liquid crystal panel 53, and a toner consumption amount per sheet (mg/sheet) is calculated by a toner consumption amount calculation means 38 according to the following equation:

Toner consumption amount per sheet (mg/sheet)= (calculation toner consumption amount)/(integrated value of the number of copying sheets)= [(total toner consumption amount stored in memory 41)+(toner consumption amount in current toner bottle 25)]/(integrated value of copying sheet counter 36)={(total toner consumption amount stored in memory 41) +[(initial filling amount of developer in toner bottle 25)−(detected residual toner amount)]}/(integrated value of copying sheet counter 36) (4).

From the calculation result based on the calculation equation (4), a subsequent toner bottle 25, of a toner/carrier ratio, to be replaced with the old toner bottle 25 is judged in accordance with Table 1 by a subsequent toner bottle judgement means 39, and then a bottle number of the subsequent toner bottle 25 is displayed on the liquid crystal panel 53.

The user or the service person prepares a corresponding toner bottle 25 in accordance with the display and replaces the old toner bottle 25 with the corresponding toner bottle 25.

In this embodiment, even after the toner bottle 25 is replaced, different from Embodiment 1, the value of the copying sheet counter 36 is kept as it is. Further, at the time of replacement of the toner bottle 25, a toner consumption amount in the toner bottle 25 is integrated in the memory 41.

Accordingly, the toner consumption amount per sheet (mg/sheet) calculated at the time of toner bottle 25 replacement means an average toner consumption amount from the time of shipping the image forming apparatus 1 to that point of time.

According to this embodiment, the following effect is achieved.

The toner consumption amount per sheet (mg/sheet) used for judging the subsequent toner bottle 25 (to be replaced with the old toner bottle 25) is an average toner consumption amount from the shipping of the image forming apparatus 1 to that point of time, so that the subsequent toner bottle 25 of a toner/carrier ratio is judged depending on how the image forming apparatus 1 is used from the time of shipping. As a result, the carrier is supplied more accurately, so that it is possible to retain a high-quality image.

Embodiment 3

In this embodiment, similarly as in Embodiments 1 and 2, it is possible to selectively dispose a plurality of toner bottles 25 of different types. However, in this embodiment, a supply table used for supplying developer to a developing apparatus 3 is changed depending on the types of the toner bottles 25. The supply table means a table which is provided in order to adjust a toner supply amount depending on an output of a toner concentration sensor 51 and shows a relationship between the output of the toner concentration sensor 51 set in the controller 34 and an amount (number) of rotation of a supply screw 28*a* detected by an encoder 29. The rotation amount of the supply screw 28*a* corresponds to a supply amount of developer.

Figure 3:
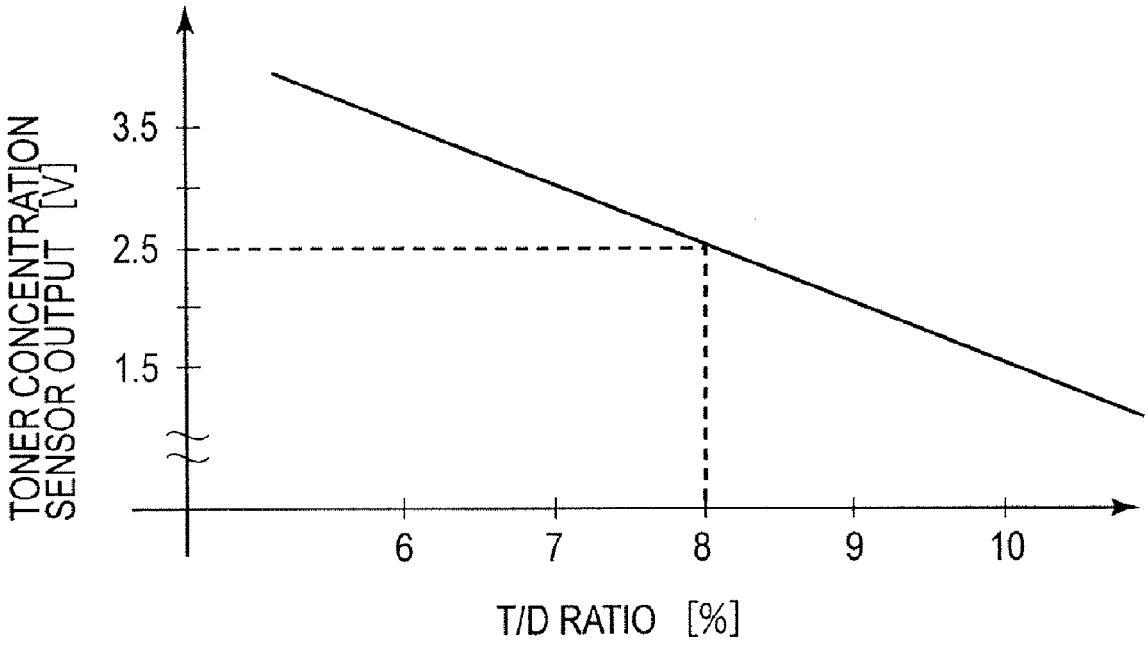
FIG. 3 is a graph showing a relationship between an output value of a developer concentration detection means and a T/D (toner/developer) ratio in developer.

The toner concentration sensor 51 for detecting a mixing weight ratio of toner particles to developer (toner particles and a carrier) of the developer contained in a developer container 24 (hereinafter, referred to as a "T/D ratio" is provided to the developer container 24. The toner concentration sensor 51 determines a toner concentration by detecting a permeability of the developer. A relationship between a T/D ratio and an output of the toner concentration sensor 51 is shown in FIG. 3. For example, when the permeability becomes small, this means an increase in T/D ratio in the developer. On the other hand, when the permeability becomes large, this means a decrease in T/D ratio in the developer.

In this embodiment, a user inputs a carrier ratio of developer contained in a toner bottle 25 into an operation portion 54, of an electrophotographic copying machine, communicating with a subsequent toner bottle judgement means 39 shown in FIG. 1. In this embodiment, toner bottles of four types having different carrier ratios of 5%, 15%, 30% and 45% are prepared. Other constitutions are similar to those in Embodiment 1.

Figure 4:
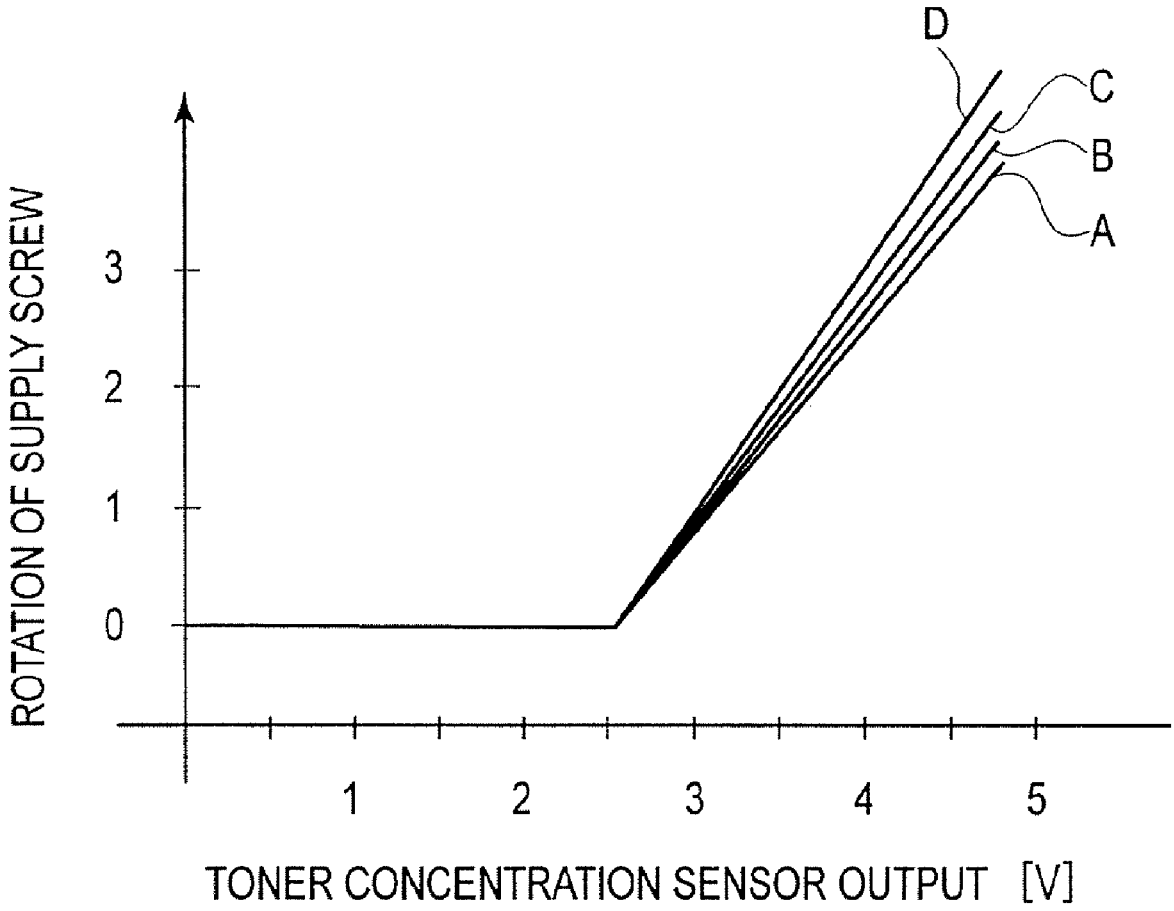
FIG. 4 is a graph showing an embodiment of a developer supply table employed in the present invention.

FIG. 4 shows a supply table used for toner supply control when toner bottle 25 of different carrier ratios are used. Incidentally, the supply table is provided in an unshown apparatus control means. Referring to FIG. 4, an abscissa represents an output (value) of the toner concentration sensor 51 and an ordinate represents an amount (number) of rotation of the supply screw 28*a*. Lines A, B, C and D represent the cases of the carrier ratios of 5%, 15% 30% and 45%, respectively. As shown in FIG. 4, different supply tables are used depending on the carrier ratios.

In FIG. 4, the reason why the slopes of, e.g., the lines A and D in the supply tables with respect to the respective carrier ratios is that an amount of toner contained in developer which is discharged when the supply screw 28*a* makes one rotation is different with respect to the respective carrier ratios. The amounts (weights) of toner contained in developer discharged when the supply screw 28*a* used in this embodiment makes one rotation are 0.202 g, 0.197 g, 0.188 g, and 0.174 g for the carrier ratios of 5%, 15%, 30% and 45%, respectively, of the respective toner bottles 25. With a less amount of toner contained in developer per one rotation of the supply screw 28*a*, the slope of the supply table becomes steeper.

Figure 5:
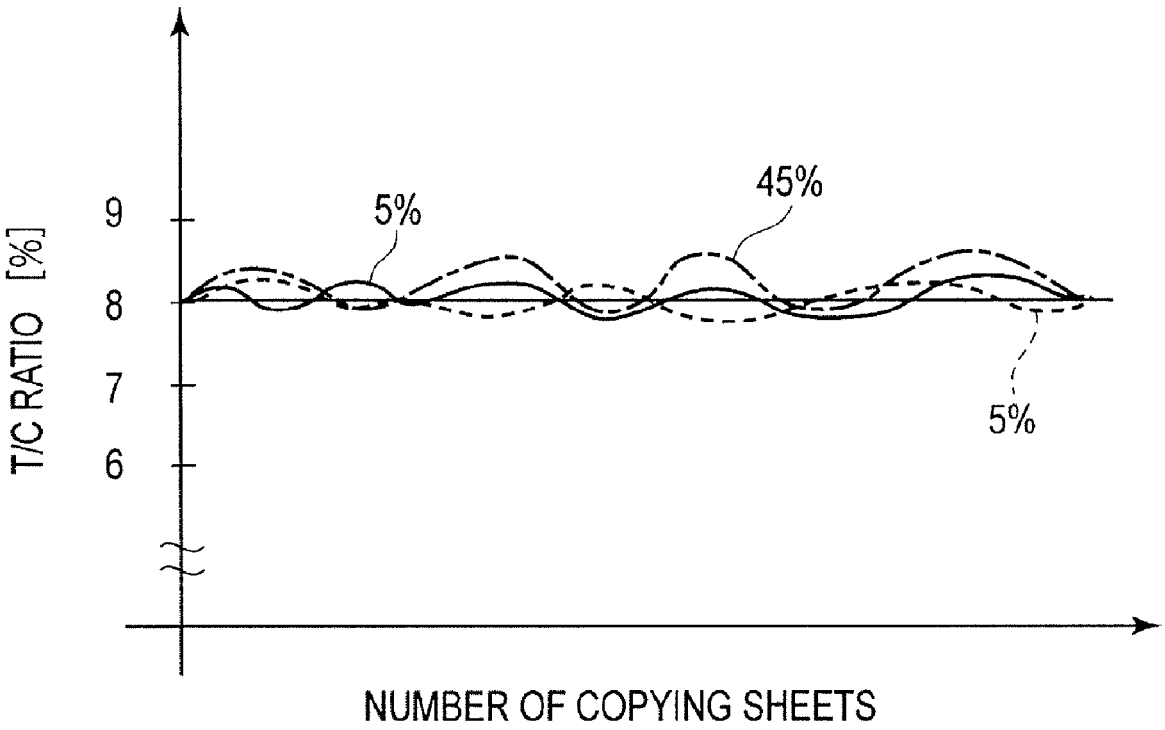
FIG. 5 is a graph showing a change in T/C (toner/carrier) ratio in a developing means with respect to a number of image formation by the image forming apparatus of the present invention.

FIG. 5 is a graph showing a ratio of toner to a carrier (T/C ratio) converted from an output of the toner concentration sensor 51 when originals having different image densities are continuously copied. An abscissa represents the number of copying sheets, i.e., an elapsed time, and an ordinate represents a T/C ratio of developer in the developer container 24. In the case of the developing apparatus 3 in this embodiment, an appropriate T/D ratio is 8%. In this embodiment, supply control is performed so as to provide a T/C ratio of 8% in accordance with the supply tables. In FIG. 5, the supply control is performed by using the supply table of line A (FIG. 4) for the toner bottle 25 of the carrier ratio of 5% indicated by a solid line, the supply table of line D (FIG. 4) for the toner bottle 25 of the carrier ratio of 45% indicated by alternate long and short dashed lines, and the supply table of line D (FIG. 4) for the toner bottle 25 of the carrier ratio of 5% indicated by a broken line, respectively.

The solid line and the alternate long and short dashed lines are within the range of 7.5-8.4% with respect to the appropriate T/C ratio (8%), and the broken line is within the range of 8.5-8.9%. Accordingly, in any supply control for the toner bottle 25, the T/C ratio in the developing apparatus is not largely deviated from the appropriate value of 8%. As a result, it is possible to confirm an effect of supply control using the supply tables depending on the carrier ratios of the toner bottles.

In this embodiment, the carrier ratios of the toner bottles 25 are manually inputted by the operator but it is also possible to employ such a constitution that each toner bottle 25 is provided with an IC chip or the like in which information on a carrier ratio is written, and the information is automatically read when the toner bottle 25 is mounted in the main assembly of the image forming apparatus.

Embodiment 4

In this embodiment, in the image forming apparatus of Embodiment 3, as the developer concentration detection means, a carrier concentration sensor 52 for detecting a carrier ratio of developer in the neighborhood of the supply screw 28*a* for supplying the developer is disposed and used instead of the toner concentration sensor 51. The developer supply control is performed on the basis of the detection result of the carrier concentration sensor 52.

As a result, it becomes possible to detect the carrier ratio of developer immediately before the developer is supplied to the developer container 24. For example, even when the operation changes the toner bottle 25 of the carrier ratio of 5% to the toner bottle 25 of the carrier ratio of 45%, it is possible to accurately detect the carrier ratio, so that it also becomes possible to select an optimum supply table.

Herein, the toner concentration sensor 51 performs the detection operation by detecting the permeability. In this embodiment, similarly, the carrier concentration sensor 52 performs the detection operation by detecting the permeability. More specifically, the carrier concentration sensor 52 utilizes an inductance component of coils provided in the sensor and is of a magnetic bridge-type utilizing a differential transformer. The coils comprise a drive coil, a referential coil, and a detection coil which are concentrically superposed and effect differential output in correspondence with a change in detection concentration.

Figure 10:
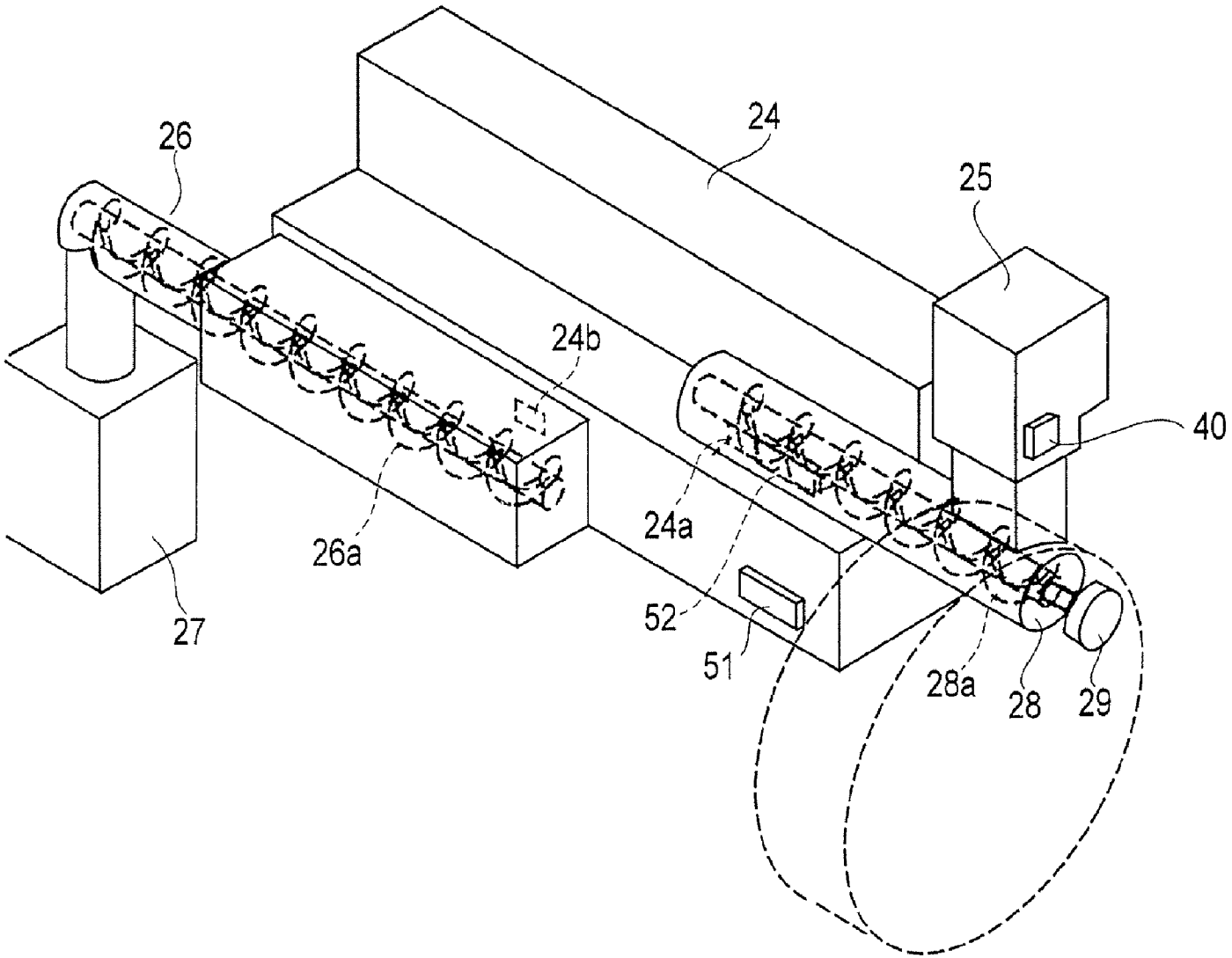
FIG. 10 is a perspective view showing an embodiment of a developing means use din the image forming apparatus of the present invention.

Incidentally, in FIG. 10, the toner concentration sensor 51 is disposed to face the developer contained along a side wall of the developer container 24 in order to detect the T/D ratio of the developer in the developer container 24, and the carrier concentration sensor 52 is disposed to face the developer fed by the supply screw 28*a* in the neighborhood of the position of developer supply opening 24*a* in the developer container 24. However, the carrier concentration sensor 52 may also be disposed to face the developer in such a manner that an accommodation portion for storing the developer of the toner bottle 25 is provided in the main assembly of the image forming apparatus and the sensor 52 faces the developer at the accommodation portion.

Embodiment 5

Figure 6:
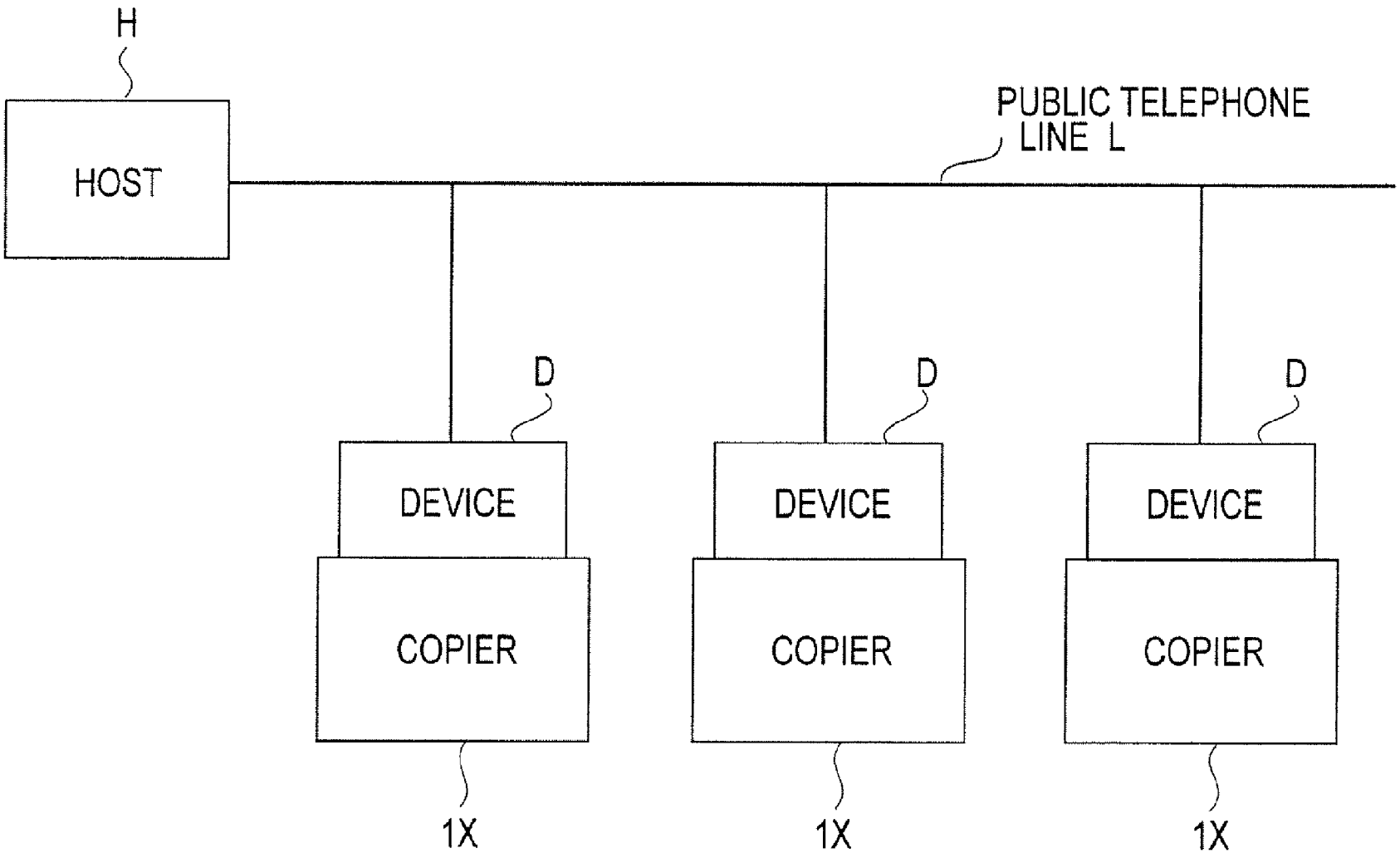
FIG. 6 is a block diagram showing an embodiment of the management system of the present invention.

In this embodiment, the selection means for selecting the toner bottle 25 to be mounted in the image forming apparatus 1 from the plurality of toner bottles 25 of different carrier ratios in the developer is disposed outside the image forming apparatus 1, not within the image forming apparatus 1 as in Embodiments 1 to 4 described above, and more specifically, in disposed in a networked computer. A management system of the image forming apparatus 1 provided with such a selection means will be described. FIG. 6 schematically illustrates an example of a copying machine management system in this embodiment.

As shown in FIG. 6, the copying machine management system is constituted by a plurality of copying machines (copiers) 1× each disposed on a user side and a host computer H (information management device) for maintenance management disposed in a management center of a service provider. A device D, for communication management, provided as a terminal apparatus to each of the copiers 1× is networked with the host computer H through a public telephone line L. The copier management device D transmits data for managing the corresponding copier 1× to the host computer H, thus being connected with the public telephone line L. Incidentally, the network connection may also be established through another communication medium such as an optical fiber line or a cable line.

Figure 7:
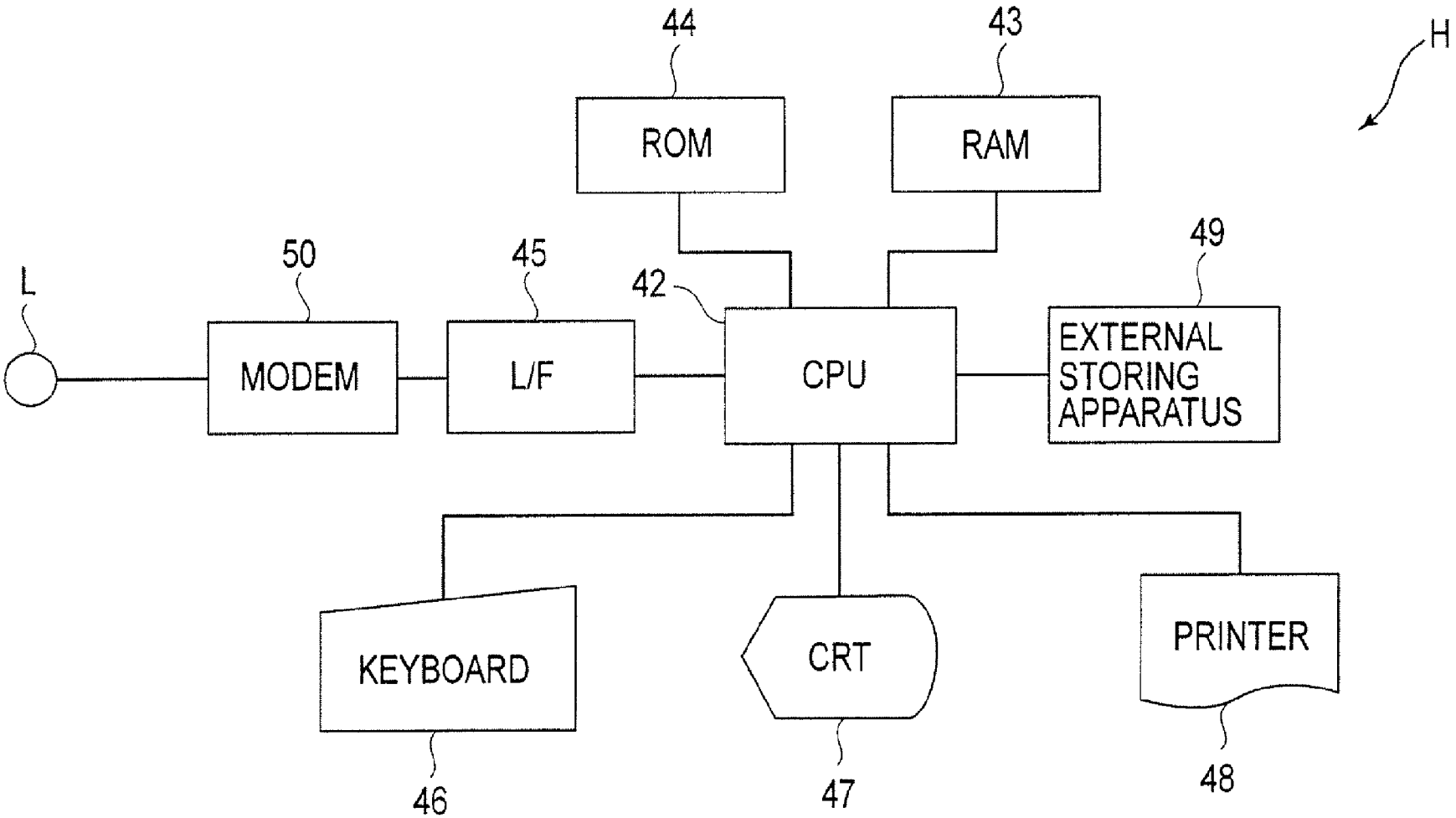
FIG. 7 is a block diagram showing an embodiment of a host computer used in the management system of the present invention.

The host computer H is, as shown in FIG. 7, provided with a CPU 42, an RAM 43 and an ROM 44 which are connected with the CPU 42, and an input/output interface 45. Further, to the CPU 42, a keyboard 46 for input, a CRT 47 for display, a printer 48 for printing, an external storage apparatus 49, and the like are also connected. The input/output interface 45 is provided with an input/output terminal such as an RS-232C or the like through which the input/output interface 45 is connected with the public telephone line L via a modem 50 for communication.

Figure 8:
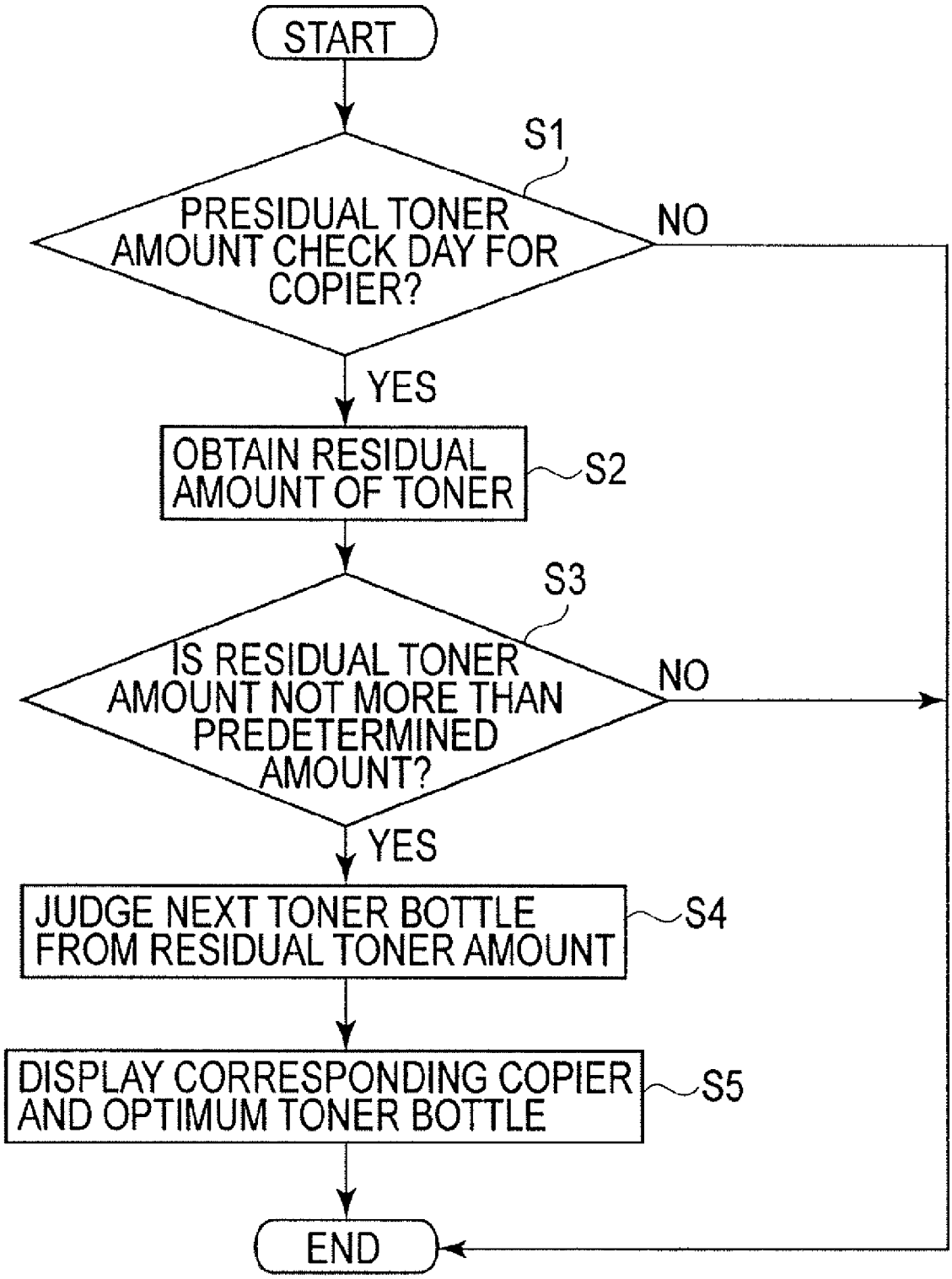
FIG. 8 is a flow chart showing an embodiment of an operation by the host computer used in the present invention.

Then, an operation of the CPU 42 of the host computer H will be described with reference to FIG. 8, wherein the following steps S1 and S5 are performed.

S1: The CPU 42 judges whether or not the day is a residual toner amount check day with respect to the corresponding copier 1×. When the day is the residual toner amount check day, the operation goes to a step S2 but when the day is not the residual toner amount check day, the judgement operation is completed.

S2: In the case where the day is judged as the residual toner amount check day in the step S1 , the residual toner amount of the corresponding copier 1× is obtained in this step S2.

S3: In this step S3, when the obtained residual toner amount is not more than a predetermined amount, the residual toner amount is judged to be small and the operation goes to a step S4. When the residual toner amount is more than the predetermined amount, the residual toner amount is judged to be sufficient and the operation (processing) is completed.

S4: IN this step S4, a subsequent toner bottle 25 (to be replaced with the old toner bottle 25) of a T/C ratio is judged on the basis of an integrated value of an unshown copying sheet counter, provided to the copier 1× or the host computer H, and a toner consumption amount.

S5: In this step S5, the numbers of the corresponding copier 1× and the judged toner bottle 25 of an optimum carrier ratio are displayed on the picture are of the CRT 47.

In accordance with the display on the picture area of the CRT 47 in the step S5, the service person makes a visit to a user possessing the corresponding copier 1× and replaces the old toner bottle 25 with the subsequent toner bottle 25.

Incidentally, in this embodiment, the selection means for selecting the toner bottle 25 is provided in the host computer H but other constitutions of the image forming apparatus 1 and the developing apparatus 3 are similar to those described in Embodiments 1 to 4.

In this embodiment, the host computer H receives the signal (data) for the residual toner amount from the copier 1× and judges the bottle number of the subsequent toner bottle 25. However, as described in Embodiments 1-4, the bottle number of the subsequent toner bottle 25 is judged by the controller 34 in the copier 1× and the host computer may receive the signal (data) of the subsequent toner bottle number in accordance with the management system for managing the toner bottle 25 as described with reference to FIG. 6. In this case, the selection means for selecting the toner bottle 25 is similar to that described in Embodiments 1-4 and is disposed in the image forming apparatus 1.

According to the management system in this embodiment, the following effect is achieved.

The old toner bottle can be timely replaced with an optimum toner bottle by the service person, so that it is possible to quickly and accurately make a judgement for retaining image qualities.

Embodiment 6

In this embodiment, a plurality of toner bottles 25 of different mixing ratios of toner to carrier are prepared similarly as in Embodiments 1-4. In Embodiments 1-4, at the time of shipping the image forming apparatus 1, a toner bottle 25 of a standard mixing ratio of toner to carrier is packed with the image forming apparatus 1. However, in this embodiment, the toner bottle 25 is not packed with the image forming apparatus 25.

For this reason, the user also purchases the toner bottle 25 at the time when the user purchases the image forming apparatus 1. At that time, when the user knows that an image having a large average image proportion is outputted (e.g., a graphic image is frequently formed), the user selectively purchases a toner bottle 25 of a large carrier ratio.

The operation after the purchase of the toner bottle 25 is performed in the same manner as in Embodiment 1.

According to this embodiment, the user can purchase a toner bottle 25 as desired, so that it becomes possible to supply a carrier depending on a deterioration status thereof from the start. As a result, it is possible to further retain a high-quality image.

While the invention has been described with reference to the structures disclosed herein, it is not confined to the details set forth and this application is intended to cover such modifications or changes as may come within the purposes of the improvements or the scope of the following claims.

This application claims priority from Japanese Patent Application No. 085409/2004 filed Mar. 23, 2004, which is hereby incorporated by reference.

What is claimed is:

1. A management system for managing an image forming apparatus, includes:

a developing device for developing an electrostatic image, formed on an image bearing member, with toner;

a developer supply container which contains developer containing toner and a carrier and is detachably mountable to a container mounting portion provided to a main assembly of the image forming apparatus, wherein one of a plurality of kinds of developer supply containers containing developers having different carrier ratios in the developers is selectively mountable to the container mounting portion;

a developer supply device for supplying the developer contained in the developer supply container to the developing device; and a developer discharge opening, provided in the developing device, for causing the developer in the developing device to overflow to an outside of the developing device;

the management system, comprising:

a communication management device for transmitting management data for managing the image forming apparatus;

an information management device which is connected with said communication management device in a communicable manner and manages information from said communication management device; and a notification device for providing notification of information from said information management device, a carrier deterioration information detection device for detecting information pertaining to deterioration of the carrier contained in the developer in the developing device;

wherein said information management device judges the kind of the developer supply container to be selected on the basis of the information pertaining to deterioration of the carrier when the developer supply container is replaced and notifies said notification device of information pertaining to the developer supply container to be selected.

2. A system according to claim 1, wherein the information pertaining to deterioration of the carrier is information on the number of image forming operations.

3. A system according to claim 2, wherein the information pertaining to deterioration of the carrier is information pertaining to an average amount of toner consumption per image forming operation.

4. A system according to claim 3, wherein said information management device selects a developer supply container so that a first developer supply container is selected when the average amount of toner consumption per image forming operation is not less than a predetermined value and a second developer supply container is selected when the average amount of toner consumption per image forming operation is less than the predetermined value, and the first developer supply container has a carrier ratio in developer contained therein larger than that in developer contained in the second developer supply container.

5. A system according to claim 2, wherein the information pertaining to deterioration of the carrier is information pertaining to an average pixel number per image forming operation.

6. A system apparatus according to claim 2, wherein said information management device selects a developer supply container which contains developer having a larger carrier ratio with an increasing number of the image forming operations performed.

* * * * *

UNITED STATES PATENT AND TRADEMARK OFFICE

CERTIFICATE OF CORRECTION

PATENT NO. : 7,349,639 B2
APPLICATION NO. : 11/743264
DATED : March 25, 2008
INVENTOR(S) : Ryuichi Kojima et al.

It is certified that error appears in the above-identified patent and that said Letters Patent is hereby corrected as shown below:

IN THE DRAWINGS:

At Sheet 1, Figure 1, "SUBSEQUESNT" should be --SUBSEQUENT--.

COLUMN 2:

Line 58, "image-hearing" should read --image-bearing--.

COLUMN 3:

Line 10, "According to another" should read --Another--.
Line 56, "developer." should read --the developer.--.

COLUMN 4:

Line 7, "use din" should read --used in--.

COLUMN 5:

Line 42, "paths" should read --path--.
Line 48, "above described" should read --above-described--.
Line 51, "above described" should read --above-described--.

COLUMN 6:

Line 6, "above described" should read --above-described--.

COLUMN 7:

Line 10, "performed In" should read --performed. ¶ In--.
Line 29, "above described" should read --above-described--.
Line 53, "above" should read --above- --.

COLUMN 9:

Line 26, "above" should read --above- --.
Line 65, "ins" should read --is--.

COLUMN 10:

Line 17, "toner" should read --the toner--.
Line 57, "are" should read --is--.

COLUMN 11:

Line 13, "sheet" should read --sheets--.
Line 19, "every" should read --of every--.

UNITED STATES PATENT AND TRADEMARK OFFICE

CERTIFICATE OF CORRECTION

PATENT NO. : 7,349,639 B2
APPLICATION NO. : 11/743264
DATED : March 25, 2008
INVENTOR(S) : Ryuichi Kojima et al.

It is certified that error appears in the above-identified patent and that said Letters Patent is hereby corrected as shown below:

COLUMN 12:
Line 57, “are” should read --is--.
Line 67, “tables with” should read --tables vary with--.

COLUMN 14:
Line 29, “in” should read --is--.
Line 49, “an” (both occurrences) should read --a--.
Line 58, “Then,” should read --Next,--.

COLUMN 15:
Line 19, “picture are” should read --picture area--.

COLUMN 16:
Line 39, “and” should be deleted.
Line 41, “device,” should read --device; and--.

Signed and Sealed this

Second Day of September, 2008

JON W. DUDAS
*Director of the United States Patent and Trademark Office*